US005605382A

United States Patent [19]

Massa

[11] Patent Number: 5,605,382

[45] Date of Patent: Feb. 25, 1997

[54] CUTTING TOOL RETENTION SYSTEM

[75] Inventor: Ted R. Massa, Latrobe, Pa.

[73] Assignee: Kennametal Inc., Latrobe, Pa.

[21] Appl. No.: 510,160

[22] Filed: Aug. 2, 1995

[51] Int. Cl.[6] ..... E21C 35/19

[52] U.S. Cl. ..... 299/107; 299/109

[58] Field of Search ..... 299/107, 109

[56] References Cited

U.S. PATENT DOCUMENTS

| | | | |
|---|---|---|---|
| 1,862,623 | 6/1932 | Harrington | 279/76 |
| 2,168,794 | 8/1939 | Fulke | 299/102 |
| 2,743,917 | 5/1956 | Krekeler et al. | 299/103 |
| 2,798,715 | 7/1957 | Brown | 299/103 |
| 2,846,790 | 8/1958 | Davis et al. | 37/457 |
| 2,907,559 | 10/1959 | Brown et al. | 299/109 |
| 2,965,365 | 12/1960 | Krekeler | 299/109 |
| 2,996,291 | 8/1961 | Krekeler | 299/109 |
| 3,088,721 | 5/1963 | Krekeler | 299/109 |
| 3,092,374 | 6/1963 | Krekeler | 299/109 |
| 3,127,153 | 3/1964 | Elders | 299/109 |
| 3,177,037 | 4/1965 | Elders | 299/109 |
| 3,254,922 | 6/1966 | Krekeler | 299/109 |
| 3,485,533 | 12/1969 | Proctor | 299/108 |
| 3,519,309 | 7/1970 | Engle et al. | 299/107 |
| 3,844,619 | 10/1974 | Haller | 299/108 |
| 4,084,856 | 4/1978 | Emmerich et al. | 299/104 |
| 4,247,150 | 1/1981 | Wrulich et al. | 299/104 |
| 4,337,980 | 7/1982 | Krekeler | 299/102 |
| 4,342,166 | 8/1982 | Johnson et al. | 37/458 |
| 4,349,232 | 9/1982 | Braun et al. | 299/109 |
| 5,067,775 | 11/1991 | D'Angelo | 299/104 |
| 5,370,448 | 12/1994 | Stewerf, Jr. | 299/107 |

FOREIGN PATENT DOCUMENTS

| | | | |
|---|---|---|---|
| 484777 | 12/1975 | Australia . | |
| 743234 | 1/1956 | United Kingdom | 299/109 |
| 1011165 | 11/1965 | United Kingdom | 299/109 |
| 1111591 | 5/1968 | United Kingdom | 299/107 |
| 2067625 | 7/1981 | United Kingdom | 299/109 |

OTHER PUBLICATIONS

"Presenting Two New Bit–Holding Systems To Hold Down Your Mining Costs" Kennametal Advertisment B91–158, published 1991.

"Kennametal Mining Products", Catalog B92–75(15)H2, published 1992.

"A Better Way to Improve Your Coal Production", Kennametal Brochure B92–58(5)E1, Published 1991.

*Primary Examiner*—David J. Bagnell

*Attorney, Agent, or Firm*—John J. Prizzi

[57] ABSTRACT

A cutting tool retention system for retaining a cutting tool having a recess. The cutting tool retention system including a support block having a main bore and a spring seat. A pin is movably mounted to the spring seat. A spring member is positioned between the spring seat and the pin so as to urge the pin into an engaging relationship with the recess of the cutting tool inserted in the main bore of the support block such that the cutting tool cannot be removed from the main bore unless the pin is withdrawn from an engaging relationship with the recess of the cutting tool.

29 Claims, 4 Drawing Sheets

CUTTING TOOL RETENTION SYSTEM

BACKGROUND

This invention relates to cutting tools, and more particularly to a retention system for retaining such tools in a support block during use.

Cutting tool assemblies for such applications as continuous mining or road milling typically comprise a cutting tool, sometimes called a cutting bit, rotatably mounted within a support block. The support block in turn is mounted onto a drum or other body, typically by welding, which in turn is driven by a suitable drive mechanism. When a number of such support blocks carrying cutting tools are mounted onto a drum, and the drum is driven, the cutting tools will engage and break up the material which is sought to be mined or removed. The general operation of such a mining machine is well known in the art.

Because the support block is exposed, it is subject to wear and abuse and must be cut or torched off the drum and replaced when unusable. In order to prolong the life of the support block, a cutting tool holder, sometimes referred to as a bit holder, tool sleeve, or bit sleeve, is sometimes employed. The cutting tool is mounted within the tool holder which in turn is fixedly held within the support block via some mechanical connection. The tool holder generally has an outer wear surface which helps to protect the support block from abuse and wear, thus minimizing or eliminating the down time periods otherwise required for drum repair. The use of such tool holders is well known in the art. For example, U.S. Pat. No. 5,067,775 to D'Angelo discloses the use of such a bit holder which is referred to as a sleeve in that patent.

Various methods have been proposed or used in the past to rotatably mount a cutting tool within a support block, or alternatively, within a tool holder which in turn is fixedly held within a support block.

For example, U.S. Pat. No. 3,519,309 to Engle et al. discloses a cutting tool retained by a captive keeper ring within a support block. More specifically, and as illustrated in FIGS. 10, 11 and 12 of the Engle et al., the cutting tool has a cylindrical shank which defines an annular shank groove adapted for receiving resilient keeper member. The keeper member as shown comprises a split keeper ring made of, for example, spring steel and has a plurality of projections distributed around its perimeter. The support block has a main bore for receiving the shank of the cutting tool. The main bore of the support block is provided with an annular block groove for receiving the projections of the keeper ring when the shank of the cutting tool is forcibly pushed into the main bore of the support block. Such a retention method is generally known and used in the art.

The cutting tool retention method disclosed in the Engle et al. patent requires that force must be applied to the cutting tool, as the cutting tool shank is inserted into the main bore of the block, in order for the resilient keeper member to be compressed within the main bore of the support block until it expands into and engages the annular block groove. A similar force in the opposite direction must be used to remove the cutting tool from the main bore of the block and if such a force is applied to the tool during operation the cutting tool would be accidentally dislodged. Because the annular shank groove is not sealed or otherwise protected to keep dirt or dust from interfering with the proper operation of the resilient keeper member, such dirt or dust could interfere with the insertion, or especially the removal, of the cutting tool. Lastly, this retention method requires that the cutting tool, the most often replaced component of a cutting tool assembly, include a separate resilient keeper member component which complicates the manufacture of such cutting tools and increases the cost.

SUMMARY

An object of the present invention is to provide an improved cutting tool retention system having a relatively simple mechanism which cannot be easily interfered with by dirt, dust or other debris. Another object of this invention is to provide a cutting tool retention system which allows a cutting tool to be rotatably but detachably retained within a support block and which also allows the retention mechanism to be easily disengaged by a user to allow easy removal of the cutting tool.

In carrying out the above objects, and other objects and features of this invention, an improved cutting tool retention system is provided for retaining a cutting tool having a recess. The improved cutting tool retention system comprises a support block having a main bore and a spring seat. A pin is movably mounted to the spring seat. A spring member is positioned between the spring seat and the pin so as to urge the pin into an engaging relationship with the recess of the cutting tool inserted in the main bore of the support block such that the cutting tool cannot be removed from the main bore unless the pin is withdrawn from an engaging relationship with the recess of the cutting tool.

Use of this invention may also include a cutting tool holder which may be inserted into the main bore of the support block and which has a tool holder bore into which the cutting tool may be inserted. The cutting tool holder also has an access opening to allow the pin to be urged into an engaging relationship with the recess of the cutting tool inserted into the tool holder bore.

In a preferred embodiment, the support block has an exterior block surface and a main bore. The support block defines a block cavity in communication with the main bore and the exterior block surface. The block cavity has a spring seat which has an exterior seat surface, an interior seat surface which defines a spring seat cavity, a top pin shaft opening, and a bottom pin shaft opening adjacent the main bore of the support block. A pin having a prying end and a retention end is slidably mounted through the top and bottom pin shaft openings. A spring member is positioned between the interior seat surface and the pin so as to urge the retention end of the pin into an engaging relationship with the recess of the cutting tool inserted in the main bore of the support block. The prying end of the pin is accessible from the exterior block surface of the support block by way of the block cavity such that the retention end of the pin may be withdrawn from an engaging relationship with the recess of the cutting tool when the prying end is pulled. Included also is a sealing component which seals the top and bottom pin shaft openings when the spring member urges the retention end of the pin into an engaging relationship with the recess of the cutting tool inserted in the main bore of the support block.

The advantages resulting from the present invention are numerous. First, the invention allows cutting tools to be securely and releasably mounted within the main bore of a support block. Furthermore, if the cutting tool recess is an annular groove, the mounting can be done to retain the cutting tool both securely and releasably, but yet still allow the cutting tool to rotate.

As another advantage, no other components, such as retaining rings or keeper members, are required to mount either the cutting tool holder or the cutting tool within the main bore of the support block.

When the sealing components are used, dust and other debris may be prevented from interfering with the proper operation of the pin.

Further objects and advantages of this invention will be apparent from the following description, reference being had to the accompanying drawings wherein the preferred embodiments of the present invention are clearly shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

DETAILED DESCRIPTION

Figure 1:
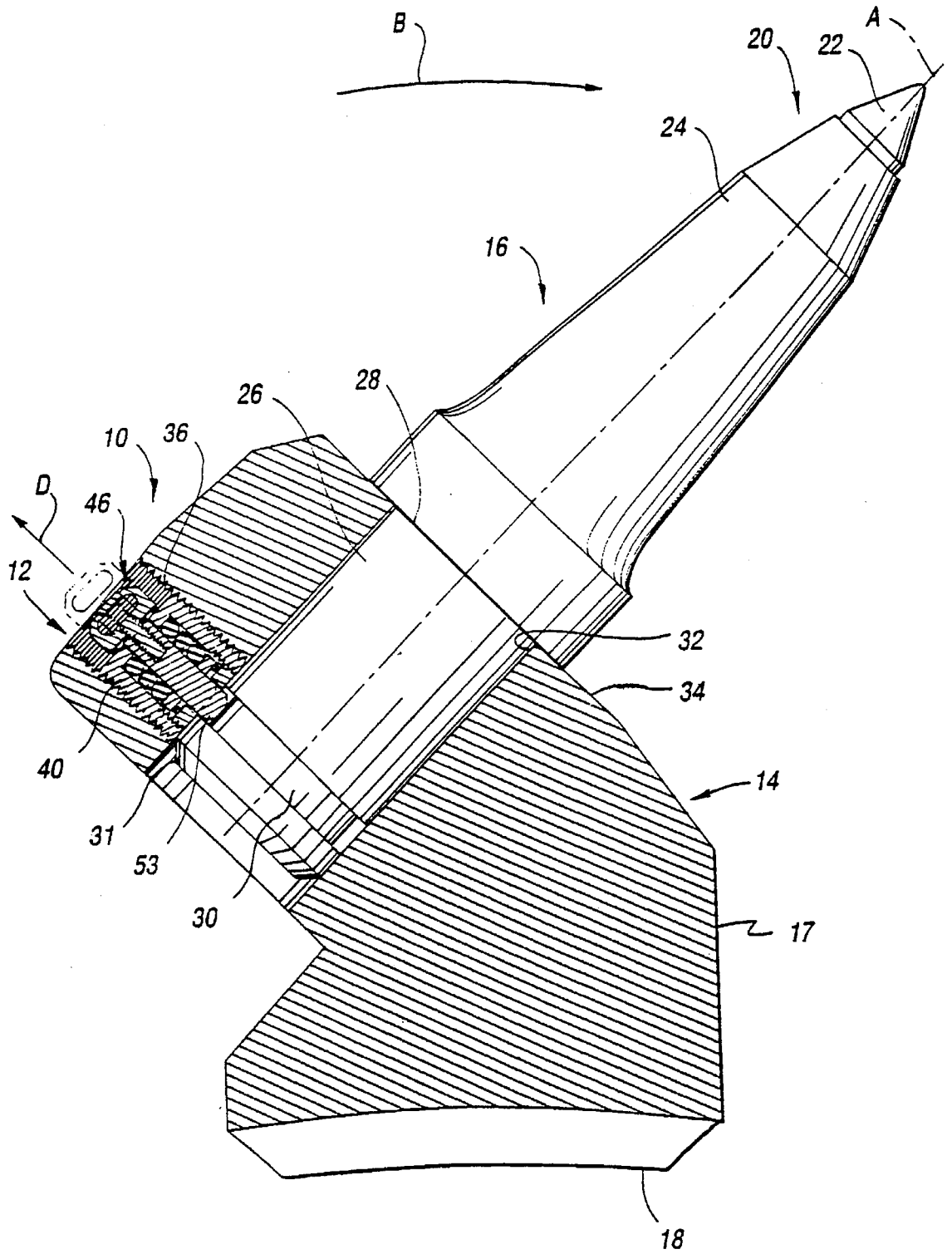
FIG. 1 is a side view of a support block, cutting tool, and spring loaded pin assembly where the support block and spring loaded pin assembly is drawn in section to show one embodiment of the invention.

One embodiment of the cutting tool retention system designated generally as 10 is shown in FIG. 1. The cutting tool retention system 10 includes a spring loaded pin assembly 12 and a support block assembly, in this embodiment support block 14, into which a cutting tool 16 may be rotatably mounted. The support block 14 has an exterior block surface 17 of which a portion is a base 18. In use, such support blocks 14 can be distributed over, and the bases 18 may be welded or otherwise connected to, the circumference and length of a drum or other body (not shown) according to any desired pattern. The drum may be driven by any conventional and suitable drive mechanism to cause the cutting tools 16 to engage and break up material that they are applied to. Such applications are well known in the art.

The cutting tool 16 typically has a cutting end 20 which generally comprises a hard cutting insert 22 typically mounted onto a generally conical outer region 24. This hard cutting insert 22 may be made from cemented tungsten carbide or any other suitable material. The hard cutting insert 22 is generally mounted at the end of the conical outer region 24 where it may be brazed or otherwise fastened into place.

The cutting tool 16 also typically includes a shank portion 26, in this case cylindrical, adjoining a shoulder 28 of the conical outer region 24. The shank portion 26 has a recess which may be, as shown in this embodiment, an annular groove 30. The bottom end of the shank portion may also have a tool chamfer 31, preferably cut at an angle of approximately 45° to the longitudinal axis "A" of the cutting tool 16. Such cutting tools are generally known in the art and will not be described in further detail here.

The support block assembly, in this embodiment the support block 14, typically has a main bore 32 surrounded by a seating shoulder region 34. The shank portion 26 of the cutting tool 16 is typically inserted into the main bore 32 of the support block 14 such that the shoulder 28 of the cutting tool 16 may seat and bear upon the seating shoulder region 34 of the support block 14. The main bore 32, and accordingly the cutting tool 16, is pitched in the direction of travel of the cutting tool 16, shown as direction "B" in FIG. 1. Such support blocks are generally known in the art and will not be described in further detail here.

For the purposes of this invention, the spring loaded pin assembly 12 is carried within a block cavity which in the embodiment shown comprises a retaining bore 36 which is perpendicular to and intersects the main bore 32 of the support block 14.

As shown in FIGS. 1, 2*a* or 2*b*, and 3, the spring loaded pin assembly 12 includes a pin 38, a spring seat 40, a spring member 42 or 42', and a sealing component 44.

Figure 2A:
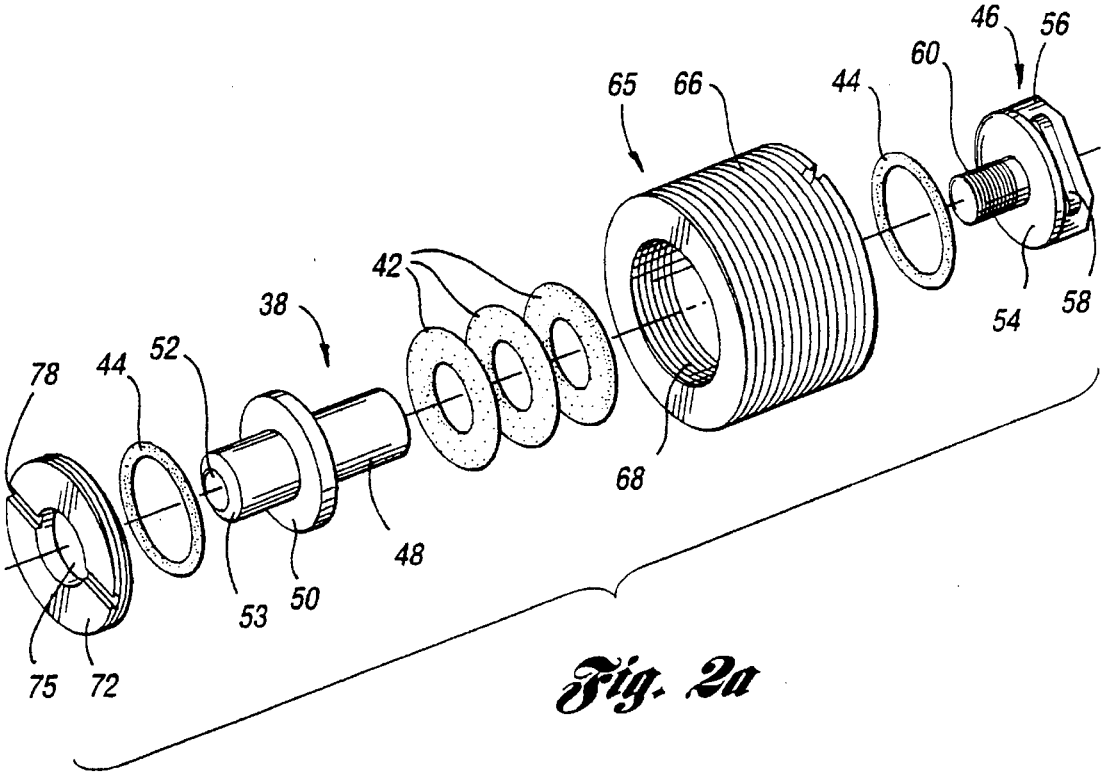
FIG. 2*a* is an exploded view of the spring loaded pin assembly.
Figure 2B:
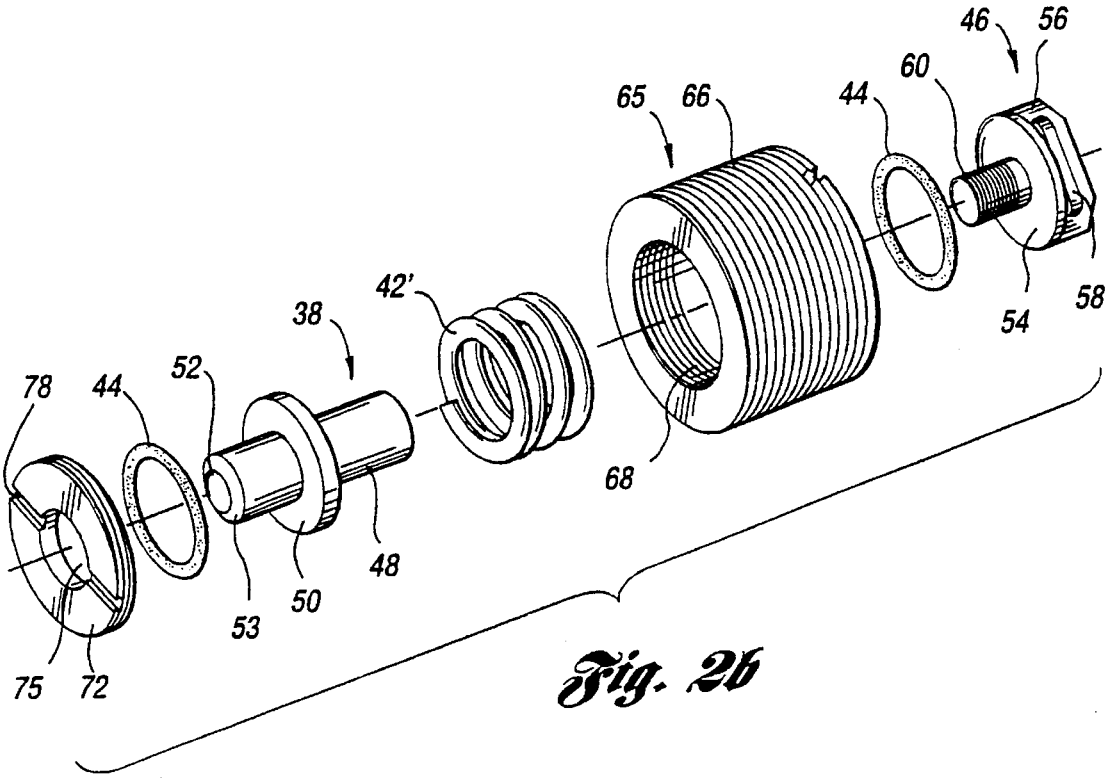
FIG. 2*b* is an exploded view of the spring loaded pin assembly showing the use of an alternative spring member.
Figure 3:
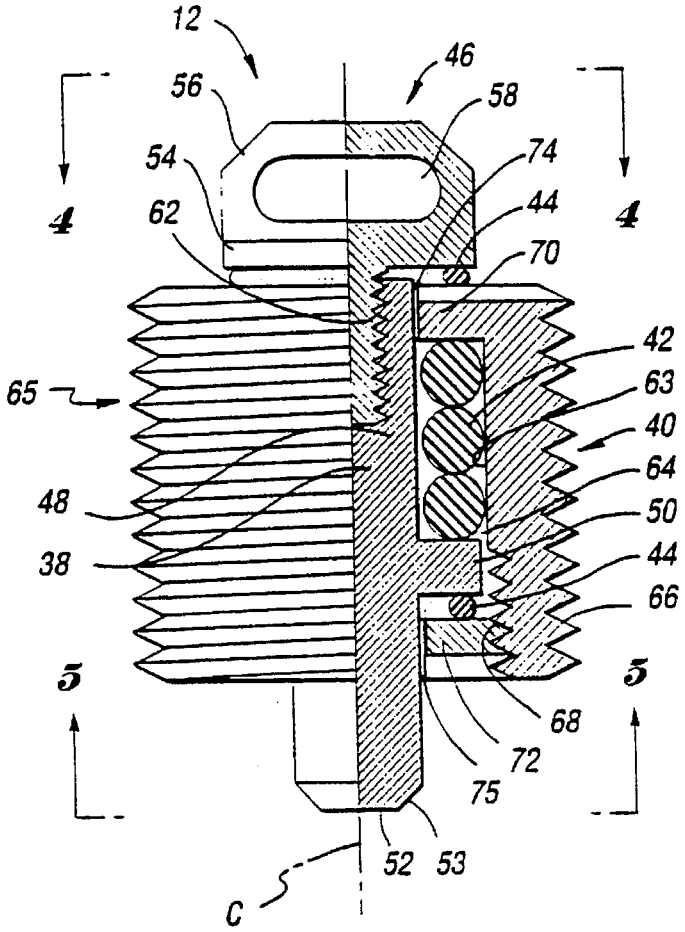
FIG. 3 is a half-section in elevation of the assembled spring loaded pin assembly which shows the spring loaded pin assembly in the engaged position.
Figure 4:
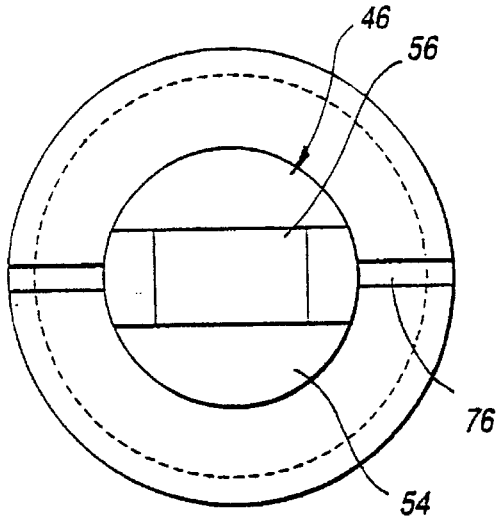
FIG. 4 is a top view of the spring loaded pin assembly.
Figure 5:
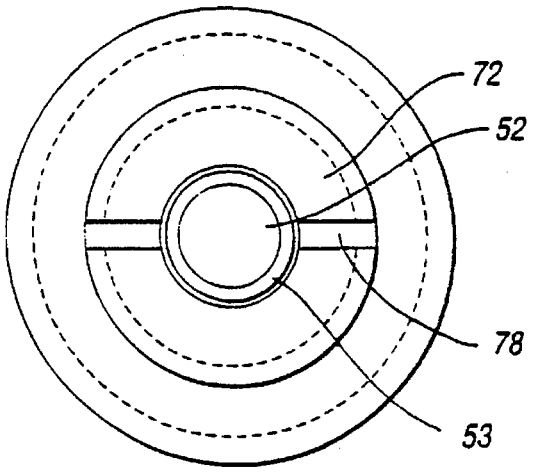
FIG. 5 is a bottom view of the spring loaded pin assembly.

As best shown in FIGS. 2*a* or 2*b* and 3, the pin 38 has a prying end 46, a pin shaft 48 having a shaft flange 50, and a retaining end 52. The retaining end 52 may have a pin chamfer 53, preferably cut at an angle of approximately 45° to the longitudinal axis "C" of the pin 38. The prying end 46 forms an upset 54, which may comprise a variety of configurations such as the flange configuration shown. The prying end 46 also includes an upstanding protrusion or leg 56 having an opening 58. The opening 58 in the embodiment shown is a slot configured to allow the entry of the operating end of a screwdriver or other suitable tool. In the embodiment shown, the prying end 46 also includes a threaded shaft 60 designed to threadably engage a threaded pin shaft bore 62 in the pin shaft 48. While the pin shaft 48 is shown in this embodiment as comprising two components, the pin 38 could alternatively be made as a one-piece construction or as two or more separate components different than those disclosed.

The spring seat 40 has an interior seat surface 63 defining a block cavity 64, the interior seat surface 63 and block cavity 64 being defined by a housing 65, which in this embodiment is cylindrical, having an exterior side wall 66, an interior side wall 68, a top inwardly extending flange 70, and a bottom inwardly extending flange 72. A top pin shaft opening 74 and a bottom pin shaft opening 75 are defined by the top inwardly extending flange 70 and the bottom inwardly extending flange 72 respectively. In the embodiment shown, the bottom inwardly extending flange 72 is formed as a disk having a threaded perimeter which threadably engages the bottommost portion of the interior side wall 68 of the cylindrical housing 65 which is likewise engagably threaded. In order to facilitate the use of a tool, such as a screwdriver, in threadably connecting the bottom inwardly extending flange 72 to the cylindrical housing 65, and as best shown in FIGS. 2*a* or 2*b*, 4 and 5, the top surface of the top inwardly extending flange 70 and the bottom surface of the bottom inwardly extending flange 72 have grooves 76 and 78 respectively.

Excluding the spring member 42 or 42', and the sealing component 44, the spring loaded pin assembly may be made from any suitable material. However, an alloy steel, such as SAE 4140 or SAE 4340, is preferred.

In the embodiment of this invention shown in FIGS. 2*a* and 3, the spring member 42 comprises a stacked series of conventional elastomeric O-rings which encircle the pin shaft 48 between the pin shaft flange 50 and the top inwardly extending flange 70 of the spring seating member 42. O-rings made from Viton® elastomeric material manufactured by DuPont, having a durometer reading of 50 on a Type A Durometer, have been found to be suitable.

Alternatively, and as shown in FIG. 2*b*, the spring member 42' may comprise a helical-type spring made from spring steel which encircles the pin shaft 48 between the pin shaft flange 50 and the top inwardly extending flange 70 of the spring seat 40. While alternative embodiments have been shown, the spring member may comprise any suitable elastic material or mechanical apparatus.

As shown, the sealing component 44 may comprise conventional O-rings which encircle the pin shaft 50. Such O-rings can be made from rubber, plastic, or any other suitable material. O-rings made from Viton® have been found to be suitable. Alternatively, the sealing component may comprise any sealing material or mechanical apparatus which protects the mechanics of the spring loaded pin assembly 12 from dirt, dust, or other debris.

As best shown by FIGS. 2*a* or 2*b* and 3, the spring loaded pin assembly 12 is assembled in the following manner. The spring member 42 is first placed in the cylindrical housing 65 such that it will seat against the top inwardly extending flange 70. The pin shaft 48 is then inserted into the cylindrical housing 65 in such a manner that the pin shaft flange 50 engages the spring member 42 while the end of the pin shaft 48 having the pin shaft bore 62 extends through the top inwardly extending flange 70 of the housing 65.

A first sealing component 44 is next placed adjacent the pin shaft flange 50 before the disk forming the bottom inwardly extending flange 72 is screwed into position such that the threaded perimeter of the bottom inwardly extending flange 72 engages the threaded portion of the interior side wall 68 of the housing 65. Accordingly, the first sealing component 44 will be sealingly compressed by the force of the spring member 42 between the bottom inwardly extending flange 72 and the pin shaft flange 50.

To complete the assembly, a second sealing component 44 is placed around a portion of the pin shaft 48 protruding through the top inwardly extending flange 70 of the cylindrical housing 65. The threaded shaft 60 of the prying end 46 is then screwed into place to threadably engage the threaded pin shaft bore 62. As a result, the second sealing component 44 is sealingly compressed by the force of the spring member 42 between the top inwardly extending flange 70 and the upset 54 of the prying end 46.

Among other alternatives, the housing 65 could also be made as a one-piece construction if the top and bottom inwardly extending flanges 70 and 72 are formed so as to enclose the required components of the spring seat 40 during manufacture.

As shown in FIG. 1, the spring loaded pin assembly 12 is then mounted within the retaining bore 36 of the support block 14. In the embodiment shown, the exterior side wall 66 of the spring seat 40 is threaded to engage the retaining bore 36 of the block support 14 which is likewise threaded. The groove 76 in the top inwardly extending flange 70 of the spring seat 40 may be utilized, in conjunction with a tool (not shown), to securely screw the spring loaded pin assembly 12 into place within the retaining bore 36. The threads within the retaining bore 36 may be discontinued just short of the main bore 32 of the support block 14 to prevent the spring seating member from protruding into the main bore 32 of the support block 14. Nylok® nylon based frictional material manufactured by Nylok Fastener Corporation, or any other suitable material or adhesive, may be employed to prevent the spring loaded pin assembly 12 from backing out of the retaining bore 36 of the support block 14 during use. As shown in FIG. 1, the retaining bore 36 is deep enough such that the prying end 52 of the pin 38 is below the surface 17 of the support block 14. This protects the prying end 52, and the pin 38 in general, during use.

Once assembled as described, the use of this invention is simple. If the bottom end of the shank portion 26 of the cutting tool 16 has a tool chamfer 31, the shank portion 26 may be forced into the main bore 32 of the support block 14 such that the tool chamfer 31 engages the pin chamfer 53 and forces the pin 38 outward in the direction designated on FIG. 1 as "D". This will in turn compress the spring member 42. As the shank portion 26 is forced farther in the main bore 32, the compressed spring member 42 will force the retaining end 52 of the pin 38 into the annular groove 30 of the cutting tool 16.

Alternatively, using a screwdriver or other prying tool, the opening 58 in the prying end 46 may be engaged to pull the pin 38 outward, in the direction designated on FIG. 1 as "D," to compress the spring member 42. Once the retaining end 52 of the pin 38 has been withdrawn from where it extends into the main bore 32, the shank portion 26 of the cutting tool 16 may be easily inserted. The prying end 46 of the pin 38 is then released allowing the spring member 42 to bias against the pin shaft flange 50 and urge the retaining end 52 of the pin 38 into engagement with the annular groove 30 of the cutting tool 16. Thus, no other components, such as retaining rings or keeper members, are required to mount the cutting tool 16 within the main bore 32 of the support block 14.

The retaining end 52 may be dimensioned to fit within the annular groove 30 so as to allow the cutting tool 16 to rotate but to prevent removal of cutting tool 16 from the block support 14 unless the retaining end 52 of the pin 38 is withdrawn. While the embodiment shown discloses the use of this invention with a rotatable cutting tool, this invention may also be used to engage non-rotatable tools. In such instances, the recess in the shank portion, which in the embodiment shown is annular groove 30, may have an alternative or non-annular configuration.

As can be seen in FIG. 3, when the prying end 46 of the pin 38 is released, both the upset 54 at the prying end 46 and the pin shaft flange 50 are biased against the sealing components 44 which in turn engage the top inwardly extending flange 70 and the bottom inwardly extending flange 72 respectively. As a result, the mechanism of this invention is protected from the entry of dirt, dust or other debris during use of the cutting tool 16.

The procedure for removing the cutting tool 16 from the support block 14 is simple. A prying tool, such as a screwdriver or other tool, is again used to engage the opening 58 in the prying end 46 to move the pin 38 in the direction designated "D" in FIG. 1. When the retaining end 52 has been withdrawn sufficiently from the retaining bore 36, the cutting tool 16 may be easily removed from the support block 14.

As can be seen, an additional advantage of this invention is that the cutting tool 16 cannot be removed from the support block 14 unless the pin 38 is withdrawn. Accordingly, it is highly unlikely that accidental dislodgment of the cutting tool 16 will occur during use.

Figure 6:
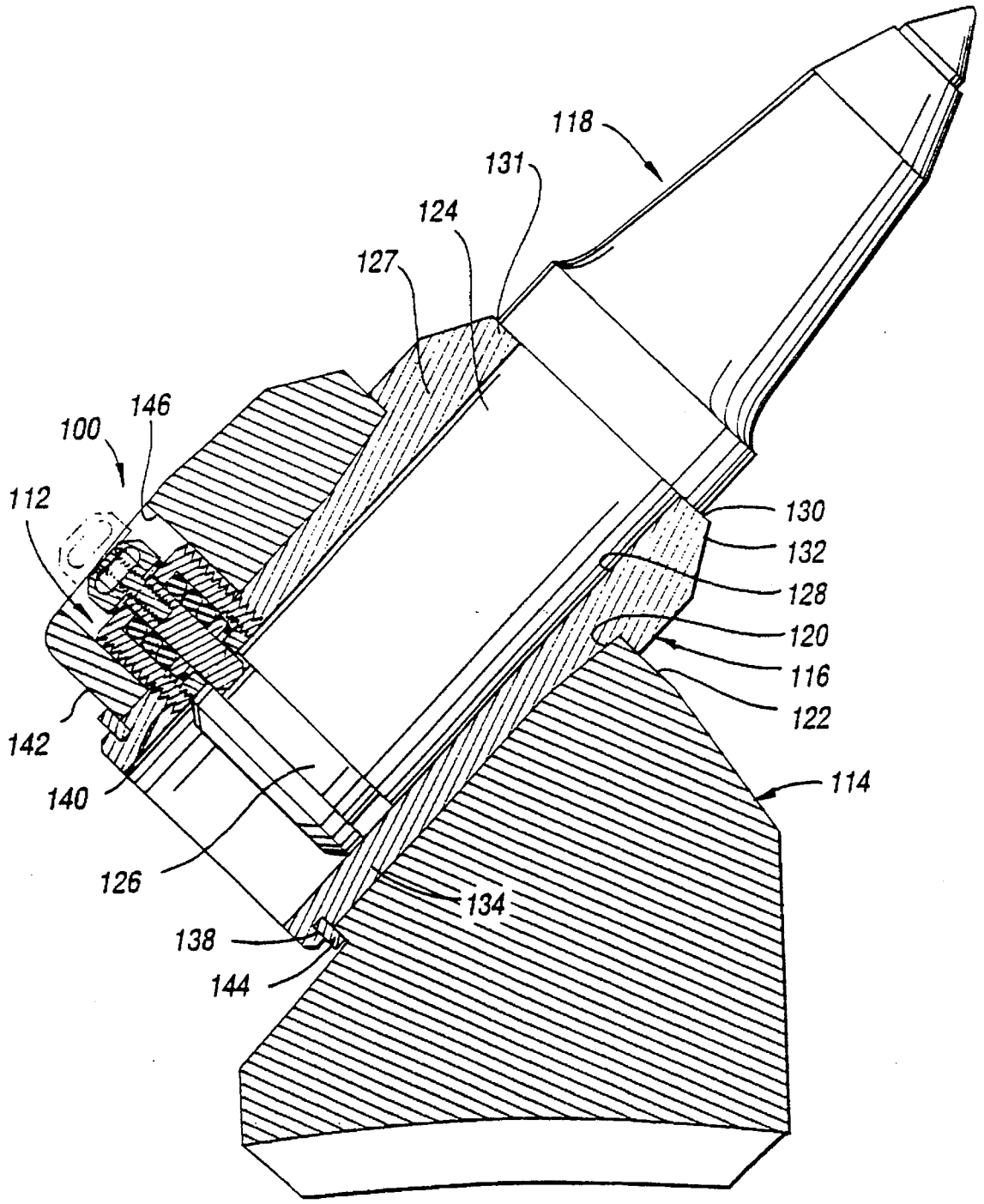
FIG. 6 is a side view of a support block, tool holder, cutting tool, and spring loaded pin assembly where the support block, spring loaded pin assembly, and tool holder are drawn in section to show an alternative embodiment of this invention.

An alternative embodiment or use of this cutting tool retention system invention is shown generally as 100 in FIG. 6. The cutting tool retention system 100 includes a spring loaded pin assembly 112, a support block assembly which in this embodiment is a support block 114 and a cutting tool holder 116, and a cutting tool 118. This alternative embodiment is similar to the embodiment disclosed in FIGS. 1, 2*a*, 2*b*, 3, 4, and 5 except that the support block assembly includes a cutting tool holder 116 into which the cutting tool 118 is inserted. The spring loaded pin assembly 112 is identical to the spring loaded pin assembly 12 of the embodiment disclosed in FIG. 1. Similarly, except for slight dimensional changes and a change in the block cavity of the block 114 noted below, the block 114 and cutting tool 118 as shown are identical to the block 14 and cutting tool 16 shown in FIG. 1. Of course, numerous block and cutting tool configurations would be suitable for use with this invention.

Like the first embodiment, the support block 114 has a main bore 120 surrounded by a seating shoulder region 122. The cutting tool 118 includes a shank portion 124 having a recess which may be, as shown in this embodiment, an annular groove 126.

The cutting tool holder 116 typically has a body 127 defining a tool holder bore 128 surrounded at the top by a seating shoulder region 130. The cutting tool holder 116 shown in this embodiment includes a wear portion 131 having a generally conical wear surface 132 adjacent to the seating shoulder region 130. The cutting tool holder 116 also typically includes a holder shank portion 134 adjoining a shoulder 136 of the wear portion 131. The bottom end of the holder shank portion 134 has an annular retainer ring groove 138. Such cutting tool holders are generally known in the art. However, for the purposes of this embodiment of this invention, the shank portion 134 also includes a holder cavity which in this embodiment comprises a threaded access bore 140 perpendicular to and intersecting the tool holder bore 128 of the cutting tool holder 116.

The holder shank portion 134 of the cutting tool holder 116 is typically inserted in the main bore 120 of the support block 114 such that the shoulder 136 of the cutting tool holder 116 may seat and bear upon the seating shoulder region 122 of the support block 114.

In the embodiment shown, when the holder shank portion 134 of the cutting tool holder 116 is fully inserted into the main bore 120 of the support block 114, the annular retainer ring groove 138 will be left exposed protruding out of the rear surface 142 of the support block 114. A retainer ring 144 may then be placed within the annular retainer ring groove 138 to prevent the cutting tool holder 116 from being dislodged from the main bore 120 of the support block 114 during use. The use of such retainer rings is generally known in the art. Other methods for mounting the holder shank portion 134 of the cutting tool holder 116 in the main bore 120 may be used. For example, another method is disclosed in copending U.S. patent application entitled "Cutting Tool Holder Retention System," filed on the same date as this application, having Attorney Docket No. K-1226, U.S. Ser. No. 08/510,451, and naming as the inventors, David Richard Siddle and Ted Richard Massa.

The spring loaded pin assembly 112 is carried within a block cavity in the support block 114 which, in the embodiment shown, comprises an unthreaded retaining bore 146 which is perpendicular to and intersecting the main bore 120 of the support block 114. The threads within the retaining bore 146 may be discontinued just short of the tool holder bore 128 to prevent the spring seating member from protruding into the tool holder bore 128. Nylock® or any other suitable material or adhesive may be employed to prevent the spring loaded pin assembly 112 from backing out of the tool holder bore 128 during use. Additionally, as shown in FIG. 6, the retaining bore 146 in the support block 114 is deep enough such that the prying end of the spring loaded pin assembly 112 is below the surface of the support block 114. This protects the prying end, and the spring loaded pin assembly 112 in general, during use.

The access bore 140 should be aligned with the retaining bore 146 of the support block 114. The spring loaded pin assembly 112 is then mounted, threadably, within the access bore 140 of the cutting tool holder 116 and may, as shown, protrude into the access bore 140 of the cutting tool holder 116. Accordingly, and similar to the embodiment shown in FIG. 1, the cutting tool 118 may be removed or inserted into the tool holder bore 128 of the cutting tool holder 116 by utilizing the spring loaded pin assembly 112 as already described with regard to the embodiment disclosed in FIG. 1.

All patents and patent applications cited herein are hereby incorporated by reference in their entirety.

While particular embodiments of the invention has been illustrated and described, it will be obvious to those skilled in the art that various changes and modifications may be made without departing from this invention. It is intended that the following claims cover all such modifications and all equivalents that fall within the spirit of this invention.

What is claimed is:

1. A cutting tool retention system for retaining a cutting tool having a recess, the cutting tool retention system comprising:

a support block having a main bore and a spring seat;

a pin movably mounted to the spring seat;

a spring member positioned between the spring seat and the pin so as urge the pin into an engaging relationship with the recess of the cutting tool inserted in the main bore of the support block such that the cutting tool cannot be removed from the main bore unless the pin is withdrawn from an engaging relationship with the recess of the cutting tool;

a cutting tool holder which is inserted into the main bore of the support block and which has a tool holder bore into which the cutting tool may be inserted, the cutting tool holder having an holder cavity to allow the pin to be urged into an engaging relationship with the recess of the cutting tool inserted into the tool holder bore of the cutting tool holder.

2. The cutting tool retention system of claim 1 wherein the support block has an exterior block surface and defines a block cavity in communication with the main bore and the exterior block surface, the spring seat being within the block cavity.

3. The cutting tool retention system of claim 1 wherein the recess of the cutting tool is an annular groove and the cutting tool may rotate in the main bore after the spring member has urged the pin into the engaging relationship with the recess of the cutting tool.

4. The cutting tool retention system of claim 1 wherein the pin has a prying end and a retention end, the retention end being urged by the spring member into an engaging relationship with the recess of the cutting tool inserted into the main bore of the support block such that the cutting tool cannot be removed from the main bore unless the retention end of the pin is withdrawn from an engaging relationship with the recess of the cutting tool by pulling the prying end.

5. The cutting tool retention system of claim 1 wherein the pin has a pin chamfer which, when the cutting tool is forced into the main bore of the support block, engages the cutting tool so as to urge the pin out of the way of the cutting tool and compress the spring member such that when the cutting tool is forced farther into the main bore of the support block the compressed spring member will urge the pin into an engaging relationship with the recess of the cutting tool such that the cutting tool cannot be removed from the main bore unless the pin is withdrawn from an engaging relationship with the recess of the cutting tool.

6. A cutting tool retention system for retaining a cutting tool having a recess, the cutting tool retention system comprising:

a support block having an exterior block surface and a main bore, the support block defining a block cavity in communication with the main bore and the exterior block surface, the block cavity having a spring seat;

a pin having a prying end and a retention end, the pin being movably mounted within the block cavity of the support block;

a spring member positioned between the spring seat and the pin so as urge the retention end of the pin into an engaging relationship with the recess of the cutting tool inserted in the main bore of the support block, the prying end being accessible from the exterior block surface of the support block by way of the block cavity such that the retention end of the pin may be withdrawn from an engaging relationship with the recess of the cutting tool when the prying end is pulled;

wherein the spring seat has an exterior seat surface, an interior seat surface which defines a spring seat cavity, a top pin shaft opening, and a bottom pin shaft opening adjacent the main bore of the support block, the pin being slidably mounted through the top and bottom the pin shaft openings, the spring member being positioned between the interior seat surface of the spring seat and the pin; and a sealing component which seals the top and bottom pin shaft openings when the spring member urges the retention end of the pin into an engaging relationship with the recess of the cutting tool inserted in the main bore of the support block.

7. The cutting tool retention system of claim 6 wherein the cutting tool cannot be removed from the main bore after the spring member has urged the retention end of the pin into an engaging relationship with the recess of the cutting tool unless the retention end of the pin is withdrawn from an engaging relationship with the recess of the cutting tool.

8. The cutting tool retention system of claim 6 wherein the recess of the cutting tool is an annular groove and the cutting tool may rotate in the main bore after the spring member has urged the retention end of the pin into an engaging relationship with the recess of the cutting tool.

9. The cutting tool retention system of claim 6 wherein the retention end of the pin has a pin chamfer which, when the cutting tool is forced into the main bore of the support block, engages the cutting tool so as to urge the pin out of the way of the cutting tool and compress the spring member such that when the cutting tool is forced farther into the main bore of the support block, the compressed spring member will urge the retention end of the pin into an engaging relationship with the recess of the cutting tool such that the cutting tool cannot be removed from the main bore unless the retention end of the pin is withdrawn from an engaging relationship with the recess of the cutting tool.

10. A cutting tool retention system for retaining a cutting tool having a recess, the cutting tool retention system comprising:

a support block having a main bore;

a spring loaded pin assembly mounted to the support block, the spring loaded pin assembly having a pin and a spring member, the pin having a prying end and a retention end, the retention end being urged by the spring member into an engaging relationship with the recess of the cutting tool inserted into the main bore of the support block such that the cutting tool cannot be removed from the main bore unless the retention end of the pin is withdrawn from an engaging relationship with the recess of the cutting tool by pulling the prying end; and a sealing component which seals the spring loaded pin assembly when the spring member urges the retention end of the pin into an engaging relationship with the recess of the cutting tool inserted into the main bore of the support block.

11. The cutting tool retention system of claim 10 wherein the spring loaded pin assembly has a housing, a top flange having an exterior flange surface, and a bottom flange adjacent the main bore of the support block, the top and bottom flange slidably engaging the pin, and the spring member being positioned between the top flange and the pin so as to urge the retention end of the pin into an engaging relationship with the recess of the cutting tool inserted into the main bore of the support block.

12. The cutting tool retention system of claim 11 wherein the pin has a pin flange situated between the top flange and the bottom flange, the spring member being positioned between the top flange and the pin flange, and the prying end of the pin has an upset adjacent the exterior flange surface of the top flange.

13. The cutting tool retention system of claim 12 further including a first sealing component located between the pin flange and the bottom flange and a second sealing component located between the upset of the pin and the top flange of the housing.

14. The cutting tool retention system of claim 10 wherein the recess of the cutting tool is an annular groove and the cutting tool may rotate in the main bore after the spring member has urged the retention end of the pin into an engaging relationship with the recess of the cutting tool.

15. The cutting tool retention system of claim 10 further including a cutting tool holder which is inserted into the main bore of the block and which has a tool holder bore into which the cutting tool may be inserted, the cutting tool holder having an holder cavity to allow the retention end of the pin to be urged into an engaging relationship with the recess of a cutting tool inserted into the tool holder bore.

16. The cutting tool retention system of claim 10 wherein the retention end of the pin has a pin chamfer which, when the cutting tool is forced into the main bore of the support block, engages the cutting tool so as to urge the pin out of the way of the cutting tool and compress the spring member such that when the cutting tool is forced farther into the main bore of the support block, the compressed spring member will urge the retention end of the pin into an engaging relationship with the recess of the cutting tool such that the cutting tool cannot be removed from the main bore unless the retention end of the pin is withdrawn from an engaging relationship with the recess of the cutting tool.

17. A cutting tool retention system for retaining a cutting tool having a recess, the cutting tool retention system comprising:

a support block having a main bore;

a cutting tool holder which is inserted into the main bore of the support block, the cutting tool holder having a tool holder bore and a spring seat;

a pin movably mounted to the spring seat; and a spring member positioned between the spring seat and the pin so as to urge the pin into an engaging relationship with the recess of the cutting tool inserted into the tool holder bore of the cutting tool holder such that the cutting tool cannot be removed from the tool holder bore unless the pin is withdrawn from an engaging relationship with the recess of the cutting tool.

18. The cutting tool retention system of claim 17 wherein the cutting tool holder defines a holder cavity, the spring seat being within the holder cavity.

19. A cutting tool retention system for retaining a cutting tool having a recess, the cutting tool retention system comprising:

a support block having an exterior block surface and a main bore, the support block defining a block cavity in communication with the main bore and the exterior block surface;

a cutting tool holder which is inserted into the main bore of the support block, the cutting tool holder having an exterior holder surface and a tool holder bore, the cutting tool holder defining a holder cavity in communication with the tool holder bore and the exterior holder surface, the holder cavity having a spring seat;

a pin having a prying end and a retention end, the pin being movably mounted to the spring seat;

a spring member positioned between the spring seat and the pin so as to urge the retention end of the pin into an engaging relationship with the recess of the cutting tool inserted in the tool holder bore of the cutting tool holder, the prying end of the pin being accessible from the exterior block surface of the support block by way of the block cavity and the holder cavity such that the retention end of the pin may be withdrawn from an engaging relationship with the recess of the cutting tool when the prying end is pulled.

20. A cutting tool holder for use with a cutting tool having a recess and a support block having a main bore and a spring seat, a pin being movably mounted to the spring seat, a spring member positioned between the spring seat and the pin, the cutting tool holder comprising:

a body defining a holder bore into which the cutting tool may be inserted, the body having a wear portion and a shank portion which may be inserted into the main bore of the support block, the shank portion having a holder cavity which allows the pin to communicate with and be urged by the spring member into an engaging relationship with the recess of the cutting tool when the shank portion is inserted into the main bore and the cutting tool is inserted into the holder bore such that the cutting tool cannot be removed from the main bore unless the pin is withdrawn from an engaging relationship with the recess of the cutting tool.

21. The cutting tool holder of claim 20 wherein the spring seat may be mounted to the holder cavity.

22. The cutting tool holder of claim 21 wherein the holder cavity is a threaded access bore.

23. A spring loaded pin assembly which may be mounted to a support block having a main bore, for retaining a cutting tool having a recess which may be inserted into the main bore of the support block, the spring loaded pin assembly comprising:

a pin having a prying end and a retention end;

a spring member; and a housing having a top flange and a bottom flange, the top flange having an exterior flange surface, the top and bottom flange slidably engaging the pin, and the spring member being positioned between the top flange and the pin so as to urge the retention end of the pin into an engaging relationship with the recess of the cutting tool when the cutting tool is inserted into the main bore of the support block such that the cutting tool cannot be removed from the main bore unless the retention end of the pin is withdrawn from an engaging relationship with the recess of the cutting tool by pulling the prying end.

24. The spring loaded pin assembly of claim 23 further including a sealing component which seals the spring loaded pin assembly when the spring member urges the retention end of the pin into an engaging relationship with a recess of the cutting tool inserted into the main bore of the support block.

25. The spring loaded pin assembly of claim 23 wherein the pin has a pin flange situated between the top flange and the bottom flange, the spring member being positioned between the top flange and the pin flange, and the prying end of the pin has an upset adjacent the exterior flange surface of the top flange.

26. The spring loaded pin assembly of claim 25 further including a first sealing component located between the pin flange and the bottom flange and a second sealing component located between the upset of the pin and the top flange of the housing.

27. A spring loaded pin assembly which may be mounted to a cutting tool holder having a tool holder bore, for retaining a cutting tool having a recess which may be inserted into the tool holder bore of the cutting tool holder, the spring loaded pin assembly comprising:

a pin having a prying end and a retention end;

a spring member; and a housing having a top flange and a bottom flange, the top and bottom flange slidably engaging the pin, and the spring member being positioned between the top flange and the pin so as to urge the retention end of the pin into an engaging relationship with the recess of the cutting tool when the cutting tool is inserted into the tool holder bore of the cutting tool holder such that the cutting tool cannot be removed from the tool holder bore unless the retention end of the pin is withdrawn from an engaging relationship with the recess of the cutting tool by pulling the prying end.

28. A cutting tool retention system for retaining a cutting tool having a recess, the cutting tool retention system comprising:

a support block having an exterior block surface and a main bore, the support block defining a block cavity in communication with the main bore and the exterior block surface, the block cavity having a spring seat;

a pin having a prying end and a retention end, the pin being movably mounted within the block cavity of the support block;

a spring member positioned between the spring seat and the pin so as urge the retention end of the pin into an engaging relationship with the recess of the cutting tool inserted in the main bore of the support block, the prying end being accessible from the exterior block surface of the support block by way of the block cavity such that the retention end of the pin may be withdrawn from an engaging relationship with the recess of the cutting tool when the prying end is pulled;

wherein the spring seat has an exterior seat surface, an interior seat surface which defines a spring seat cavity, a top pin shaft opening, and a bottom pin shaft opening adjacent the main bore of the support block, the pin being slidably mounted through the top and bottom pin shaft openings, the spring member being positioned between the interior seat surface of the spring seat and the pin;

wherein the pin has a pin flange situated within the spring seat cavity, the spring member being positioned between the interior seat surface and the pin flange, and the prying end of the pin having an upset outside the spring seat cavity; and a first sealing component located between the pin flange and the interior seat surface of the spring seat and a second sealing component located between the upset of the pin and the exterior seat surface.

29. A cutting tool retention system for retaining a cutting tool having a recess, the cutting tool retention system comprising:

a support block having an exterior block surface and a main bore, the support block defining a block cavity in communication with the main bore and the exterior block surface, the block cavity having a spring seat;

a pin having a prying end and a retention end, the pin being movably mounted within the block cavity of the support block;

a spring member positioned between the spring seat and the pin so as urge the retention end of the pin into an engaging relationship with the recess of the cutting tool inserted in the main bore of the support block, the prying end being accessible from the exterior block surface of the support block by way of the block cavity such that the retention end of the pin may be withdrawn from an engaging relationship with the recess of the cutting tool when the prying end is pulled; and a cutting tool holder which is inserted into the main bore of the support block and which has a tool holder bore into which the cutting tool may be inserted, the cutting tool holder having an holder cavity to allow the retention end of the pin to be urged into an engaging relationship with the recess of the cutting tool inserted into the tool holder bore of the cutting tool holder.

* * * * *